US010531703B2

(12) United States Patent
Venturato

(10) Patent No.: US 10,531,703 B2
(45) Date of Patent: Jan. 14, 2020

(54) SKI BOOT SHELL WITH SPOILER

(71) Applicant: Rossignol Lange S.r.l., Montebelluna (IT)

(72) Inventor: Remo Venturato, Montebelluna (IT)

(73) Assignee: ROSSIGNOL LANGE S.R.L., Montebelluna (IT)

( * ) Notice: Subject to any disclaimer, the term of this patent is extended or adjusted under 35 U.S.C. 154(b) by 282 days.

(21) Appl. No.: 13/627,534

(22) Filed: Sep. 26, 2012

(65) Prior Publication Data

US 2013/0074373 A1 Mar. 28, 2013

(30) Foreign Application Priority Data

Sep. 26, 2011 (EP) ..... 11425241

(51) Int. Cl.
*A63B 5/04* (2006.01)
*A43B 5/04* (2006.01)

(52) U.S. Cl.
CPC ..... *A43B 5/0474* (2013.01); *A43B 5/047* (2013.01); *A43B 5/0478* (2013.01)

(58) Field of Classification Search
CPC ..... A43B 7/20; A43B 5/04; A43B 5/0452; A43B 5/047; A43B 5/048; A43B 5/0431; A43B 5/0474; A43B 5/0478; A43B 5/0482; A43B 5/0472; A43B 5/00; A43B 5/1691; A43B 5/0456
USPC ..... 36/71, 89, 92, 117.1, 117.4, 117.6–8, 36/118.2, 119.1, 138
See application file for complete search history.

(56) References Cited

U.S. PATENT DOCUMENTS 3,593,435 A * 7/1971 Lange ..... A43B 5/0405 36/117.6
3,713,231 A * 1/1973 Mochizuki ..... A43B 5/0458 36/118.8
3,729,841 A * 5/1973 Wagner ..... A43B 5/0415 36/117.1
3,803,730 A * 4/1974 Hanson ..... A43B 5/0415 36/100
3,945,135 A * 3/1976 Hanson ..... A43B 5/0433 36/117.1
4,008,532 A * 2/1977 Kilbourn ..... A43B 5/0415 36/118.9
4,143,474 A * 3/1979 Blanc ..... A43B 5/0433 36/118.2

(Continued)

FOREIGN PATENT DOCUMENTS

AT 339 773 11/1977
EP 0 342 463 A 11/1989

(Continued)

OTHER PUBLICATIONS

Search Report issued by European Patent Office for priority European application 11 42 5241, dated Feb. 17, 2012.

*Primary Examiner* — Katharine Gracz
(74) *Attorney, Agent, or Firm* — Haug Partners LLP

(57) ABSTRACT

The disclosure relates to a ski boot shell having a notch in the rear upper portion thereof, a rear bearing element movably connected relative to the shell, the rear bearing element has a first position in which it abuts against at least one surface of the shell to at least partially close the notch when skiing, and a second position withdrawn backward to allow the leg of a skier to be straightened when walking.

26 Claims, 7 Drawing Sheets

(56) References Cited

U.S. PATENT DOCUMENTS 4,447,970 A * 5/1984 Delery ..... A43B 5/0456 36/118.3
4,499,676 A * 2/1985 Chalmers, II ..... A43B 5/0474 36/118.7
4,551,933 A * 11/1985 Morell ..... A43B 5/0429 36/118.2
4,565,017 A * 1/1986 Ottieri ..... A43B 1/0018 36/117.8
4,587,747 A * 5/1986 Courvoisier ..... A43B 5/0433 36/105
4,669,202 A * 6/1987 Ottieri ..... A43B 1/0018 36/118.5
4,719,709 A * 1/1988 Vaccari ..... A43B 5/0433 36/117.8
4,720,926 A * 1/1988 Marxer ..... A43B 5/0427 36/117.6
4,823,484 A * 4/1989 Couty ..... A43C 11/008 24/68 SK
4,835,886 A * 6/1989 Chemello ..... A43B 5/0405 36/117.8
4,864,743 A * 9/1989 Begey ..... A43B 5/0405 36/117.8
4,882,857 A * 11/1989 Sartor ..... A43B 5/0433 36/118.8
4,949,480 A * 8/1990 Hercog ..... A43B 5/0458 36/117.9
4,955,149 A * 9/1990 Ottieri ..... A43B 5/0435 36/117.8
5,046,268 A * 9/1991 Munari ..... A43B 5/0433 36/117.8
5,054,215 A * 10/1991 Tonel ..... A43B 5/0452 36/118.8
5,065,530 A * 11/1991 Pozzobon ..... A43C 11/16 24/68 SK
5,065,533 A * 11/1991 Paris ..... A43B 5/0474 36/118.1
5,107,609 A * 4/1992 Sartor ..... A43B 5/0478 36/118.8
5,152,085 A * 10/1992 Baggio ..... A43B 5/0474 36/118.7
5,191,728 A * 3/1993 Paris ..... A43B 5/0429 36/117.7
5,193,294 A * 3/1993 Pozzobon ..... A43B 5/04 36/117.1
5,197,209 A * 3/1993 Rolland ..... A43B 5/04 36/118.9
5,224,281 A * 7/1993 Nerrinck ..... A43B 5/048 36/118.3
5,243,774 A * 9/1993 Mattiuzzo ..... A43B 5/04 36/118.2
5,279,053 A * 1/1994 Pallatin ..... A43B 5/0409 36/10
5,345,698 A * 9/1994 Billet ..... A43B 5/04 36/118.9
5,345,699 A * 9/1994 Gallon ..... A43B 3/26 36/117.6
5,353,528 A * 10/1994 Demarchi ..... A43B 5/0456 36/118.9
5,381,612 A * 1/1995 Paris ..... A43B 5/0433 36/117.7
5,381,613 A * 1/1995 Pozzobon ..... A43B 5/04 36/117.1
5,386,649 A * 2/1995 Paris ..... A43B 5/0405 36/10
5,394,628 A * 3/1995 DeMarchi ..... A43B 5/0456 36/118.9
5,408,763 A * 4/1995 Sartor ..... A43B 5/04 280/11.231
5,425,187 A * 6/1995 Artusi ..... A43B 5/0433 36/117.1
5,490,337 A * 2/1996 Zerbinati ..... A43B 5/0415 36/117.7
5,517,771 A * 5/1996 Paris ..... A43B 5/0454 36/117.6
5,519,951 A * 5/1996 Paris ..... A43B 5/047 36/117.1
5,526,587 A * 6/1996 Sartor ..... A43B 5/0405 36/10
5,548,909 A * 8/1996 Foffano ..... A43B 5/04 36/117.1
5,564,204 A * 10/1996 Cagliari ..... A43B 5/0429 36/118.2
5,575,091 A * 11/1996 Mattiuzzo ..... A43B 3/0084 36/109
5,579,592 A * 12/1996 Benoit ..... A43B 5/0456 36/118.8
5,632,105 A * 5/1997 Bonaventure ..... A43B 5/0429 36/117.1
5,718,065 A * 2/1998 Locker ..... A43B 5/04 36/117.1
5,718,066 A * 2/1998 Chemello ..... A43B 5/0433 36/105
5,718,067 A * 2/1998 Ostinet ..... A43B 5/04 36/117.1
5,720,119 A * 2/1998 Benoit ..... A43B 5/0433 36/117.1
5,752,331 A * 5/1998 Perrissoud ..... A43B 5/0454 36/117.1
5,765,299 A * 6/1998 Hayashi ..... A43B 5/04 36/117.1
5,771,609 A * 6/1998 Messmer ..... A43B 5/0401 36/115
5,778,566 A * 7/1998 Edauw ..... A43B 5/0405 36/117.1
5,819,441 A * 10/1998 Perrissoud ..... A43B 5/0456 36/117.1
5,826,355 A * 10/1998 Vaccari ..... A43B 5/04 36/117.8
5,860,227 A * 1/1999 Perrissoud ..... A43B 5/0452 36/118.3
5,894,684 A * 4/1999 Sand ..... A43B 7/20 36/115
5,901,470 A * 5/1999 Begey ..... A43B 5/0452 36/118.2
5,921,006 A * 7/1999 Vargas, III ..... A43B 5/0452 36/118.2
5,926,979 A * 7/1999 Borel ..... A43B 5/0401 36/115
5,979,082 A * 11/1999 Pallatin ..... A43B 5/04 36/118.2
6,026,596 A * 2/2000 Seidel ..... A43B 5/0405 36/10
6,101,744 A * 8/2000 Gallon ..... A43B 5/04 36/117.1
6,474,004 B2 * 11/2002 Collavo ..... A43B 5/04 36/115
6,539,648 B1 * 4/2003 Collavo ..... A43B 5/04 36/115
6,631,919 B1 * 10/2003 West ..... A43B 5/0401 280/11.36
6,708,425 B2 * 3/2004 Parisotto ..... A43B 5/0452 36/117.2
6,755,426 B2 * 6/2004 Yvars ..... A43B 5/0401 280/11.3
7,836,612 B2 * 11/2010 Agnew ..... A43B 5/0405 36/10
7,963,050 B2 * 6/2011 Sartor et al. ..... 36/118.7
8,359,771 B2 * 1/2013 Holzer ..... A43C 11/14 36/115
8,850,720 B2 * 10/2014 Marechal ..... A43B 5/0433 36/115
2004/0187354 A1 * 9/2004 Cagliari ..... A43B 5/04 36/115
2005/0081408 A1 * 4/2005 Chaigne ..... A43B 5/04 36/117.6
2005/0102860 A1 * 5/2005 Sartor ..... A43B 5/0429 36/50.5

(56) References Cited

U.S. PATENT DOCUMENTS

| | | | | |
|---|---|---|---|---|
| 2006/0162192 | A1* | 7/2006 | Roux | A43B 1/0072<br>36/118.2 |
| 2007/0271825 | A1* | 11/2007 | Plake | A43B 5/0474<br>36/117.4 |
| 2008/0148602 | A1* | 6/2008 | Marechal | A43B 5/0433<br>36/88 |
| 2008/0172907 | A1* | 7/2008 | Sartor | A43B 5/0474<br>36/118.4 |
| 2009/0000151 | A1* | 1/2009 | Cavasin | A43B 3/26<br>36/97 |
| 2009/0000152 | A1* | 1/2009 | Agnew | A43B 5/0405<br>36/118.1 |
| 2010/0236101 | A1* | 9/2010 | Leitner | A43B 5/04<br>36/117.1 |
| 2010/0251574 | A1* | 10/2010 | Battlogg | A43B 5/0405<br>36/117.1 |
| 2010/0319220 | A1* | 12/2010 | Holzer | A43B 5/0415<br>36/117.1 |
| 2013/0074373 | A1* | 3/2013 | Venturato | A43B 5/0431<br>36/117.1 |
| 2015/0068067 | A1* | 3/2015 | Zampieri | A43B 5/0433<br>36/117.1 |

FOREIGN PATENT DOCUMENTS

| | | | |
|---|---|---|---|
| EP | 0 477 817 | A | 4/1992 |
| EP | 0 623 294 | A | 11/1994 |
| EP | 1 915 917 | A | 4/2008 |

* cited by examiner

SKI BOOT SHELL WITH SPOILER

The invention relates to a ski boot shell and a ski boot as such comprising such a shell. It also relates to a method for manufacturing a ski boot shell.

In a manner known in the state of the art, a ski boot 1, shown in FIG. 1, is generally made up of a rigid shell 9, obtained by injecting a plastic material into a production mold, on which a plastic collar 2 is fastened, hinged around an axis of rotation 3, designed to cover the bottom of the leg. This assembly forms a plastic ski boot upper, in which a comfort inner boot 6 is inserted. The shell 9 and the collar 2 have a notch over the entire length thereof to allow spacing of flaps distributed around said notch and to facilitate putting the boot on and taking it off. Closing and tightening elements 4, 5 are distributed on the flaps on either side of said notch to close and tighten the upper around the foot and the bottom of the skier's leg during skiing, to allow good guiding of his skis.

With such a boot, a problem arises when the skier needs to walk. In fact, the shape of the upper is provided for the ideal position for skiing and causes a very pronounced forward incline of the skier's leg. This position is not suitable for walking, and the stiffness of the boot amplifies the difficulty of walking with such a boot. A first action in order to walk naturally consists of detaching the closing and tightening elements 4, 5 of the boot to offer the skier a first degree of flexibility. Furthermore, since the collar 2 is rotatable around the shell, it may also straighten slightly. However, this simple release of the tightening of the upper remains insufficient in practice, and the rotation of the collar is often limited by a rear stop.

Thus, other solutions, like that described by document EP1915917, propose adding a locking/unlocking device for the connection between the collar 2 and the shell 9 so as to allow the collar to occupy a much more raised position to facilitate walking when it is unlocked.

However, in all cases, the rigid shell that rises above the skier's ankle, and which has a forward incline suitable for skiing, is still bothersome at the rear portion of the leg, and limits or even prevents straightening of the leg, and lastly represents a constraint for walking with the ski boot.

Thus, the existing ski boots remain very unsuitable for walking, and there is a need for another solution making it possible to improve walking with a ski boot.

One aim of the invention is therefore to propose a ski boot that favors walking, while preserving the best possible performance for skiing and an acceptable cost.

To that end, the invention proposes a shell that comprises a spoiler in the rear upper portion thereof movably connected to the shell, capable of occupying a first position for skiing and a second position for walking.

The invention is more specifically defined by the claims.

These subject-matters, features and advantages of the present invention will be explained in detail in the following description of one particular embodiment provided non-limitingly in relation to the appended figures, in which.

In the following description, the longitudinal direction x will be used for the horizontal direction oriented from back to front in relation to the boot, the transverse direction y for the perpendicular horizontal direction, and the vertical direction z perpendicular to the two previous directions, oriented toward the top of the boot.

Figure 1:
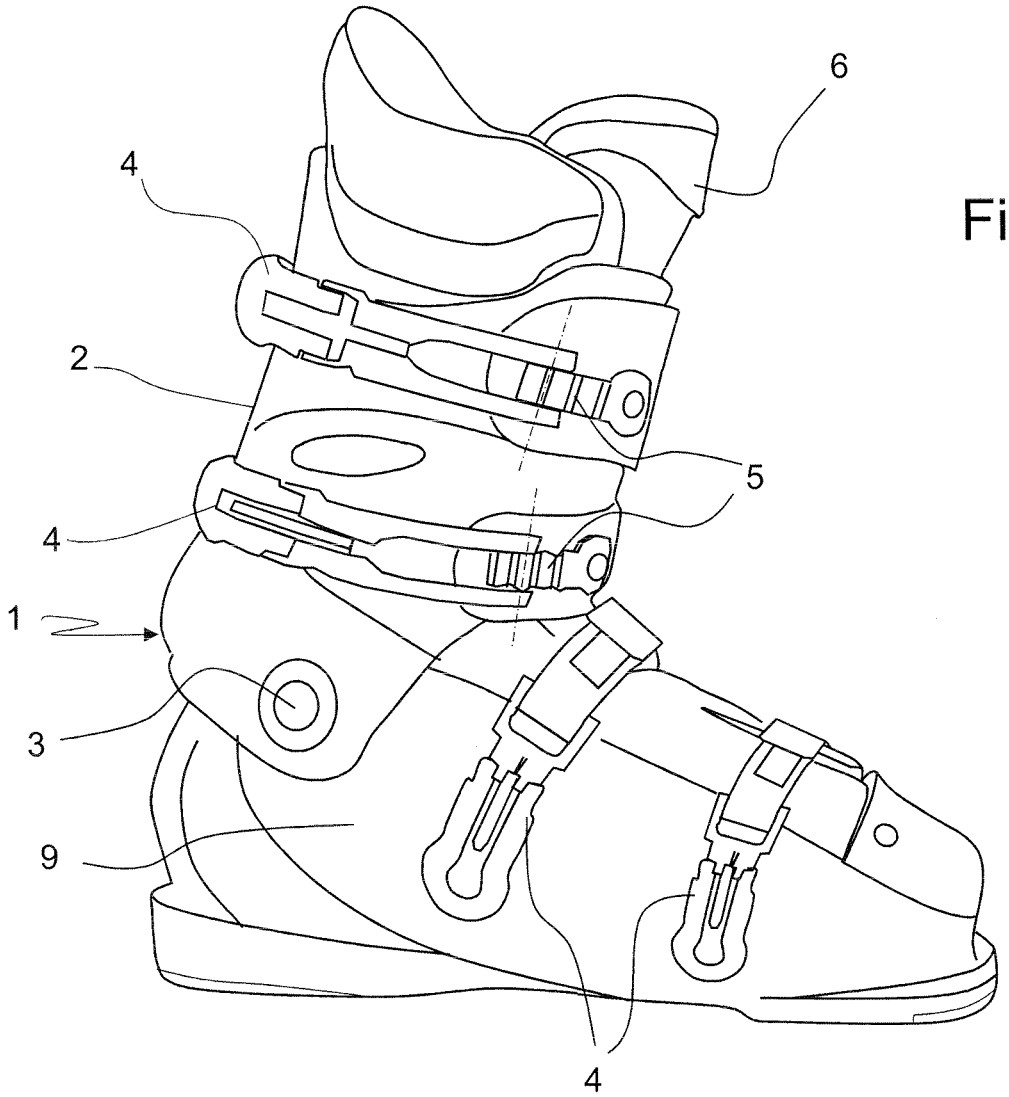
FIG. 1 is a side view of a ski boot according to the state of the art.
Figure 2:
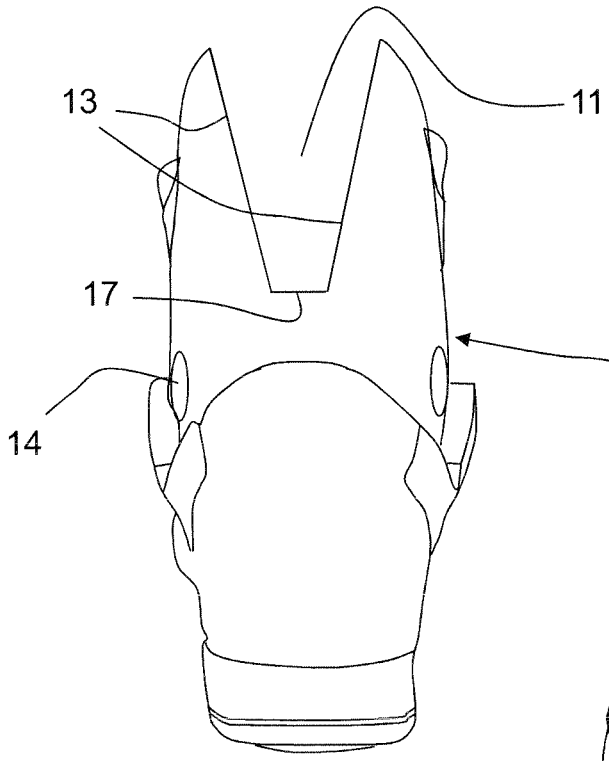
FIG. 2 shows a rear view of a ski boot shell without its spoiler according to one embodiment of the invention.
Figure 3:
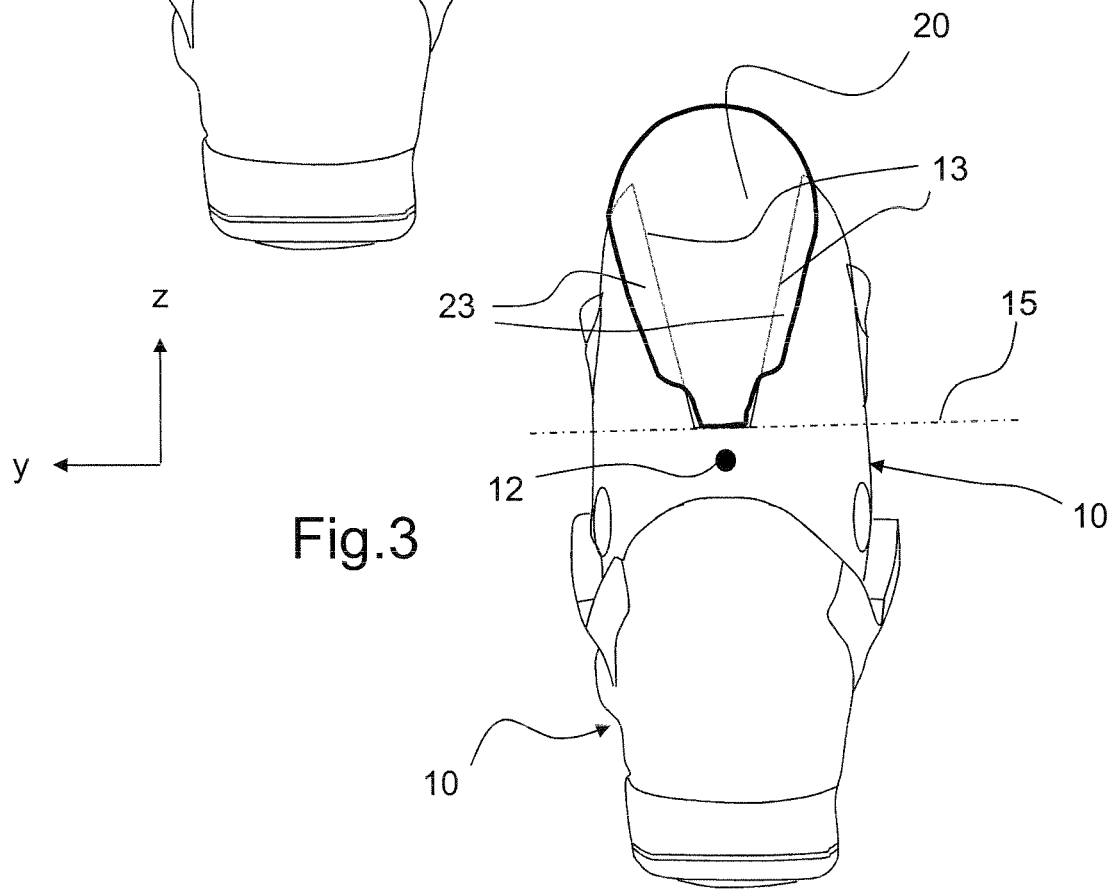
FIG. 3 shows a rear view of a ski boot shell with its spoiler according to one embodiment of the invention.

The invention is based on a ski boot comprising a typical boot architecture, as illustrated in FIG. 1.

However, the ski boot comprises a modified shell 10, more particularly shown in FIGS. 2, 3, 6, 7 and 10, which comprises a rear notch 11 at which a movable rear bearing element 20 is arranged, which we will also more simply referred to as a "spoiler." In this embodiment, each notch 11 has a trapezoidal shape, or is V- or U-shaped, which extends from the upper end of the shell to the vicinity of the axis of rotation 14 provided for a collar (not shown). This notch is substantially centered in relation to the longitudinal middle plane of the beam.

Figure 8:
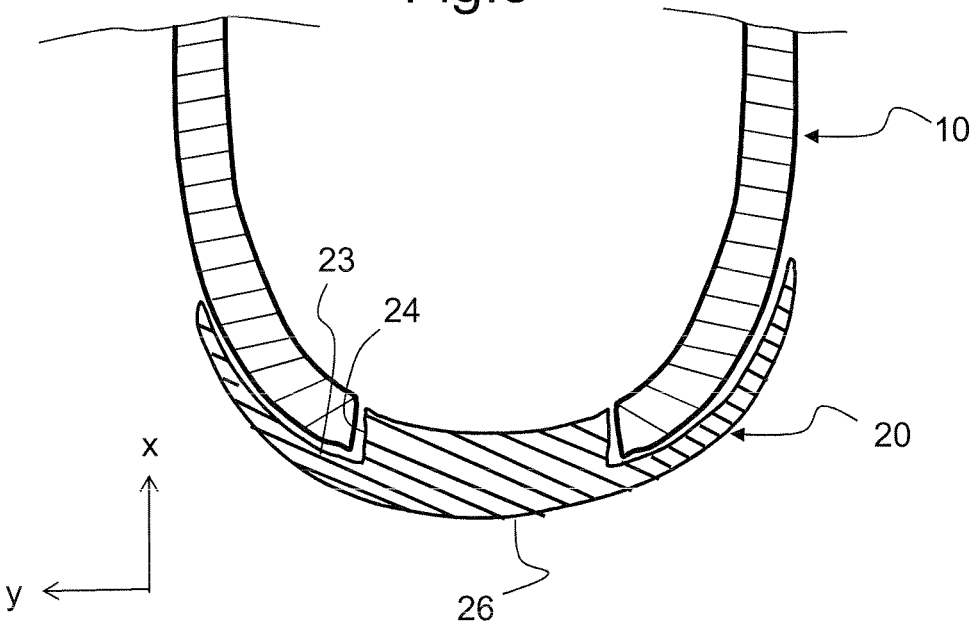
FIGS. 8 and 9 show top cross-sectional views of the ski boot shell through a horizontal plane with the spoiler respectively in the ski position and in the position tilted backward for walking according to the embodiment of the invention.

The spoiler 20 is fastened on the shell 10 at a lower point, using any fastening element 12, for example such as a rivet. It then extends toward the top of the shell, so as to cover a sufficient surface that corresponds to the notch 11 of the shell 10. It also comprises two side surfaces 23 that may overlap the rear surface of the shell, beyond the side walls 13 of the notch 11, as particularly shown in FIG. 8.

Figure 7:
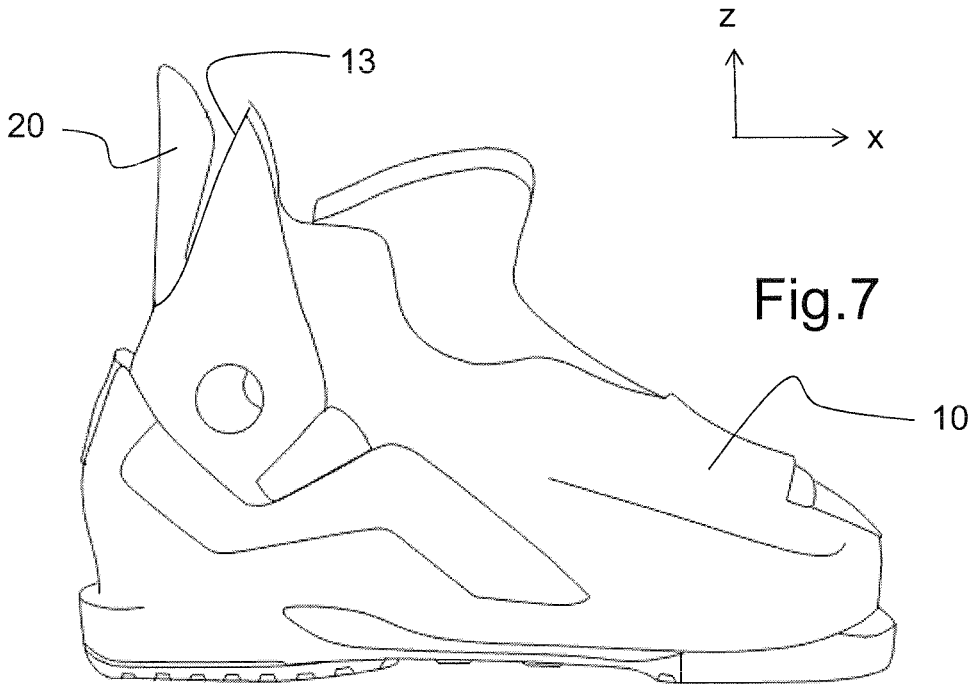
Figure 9:
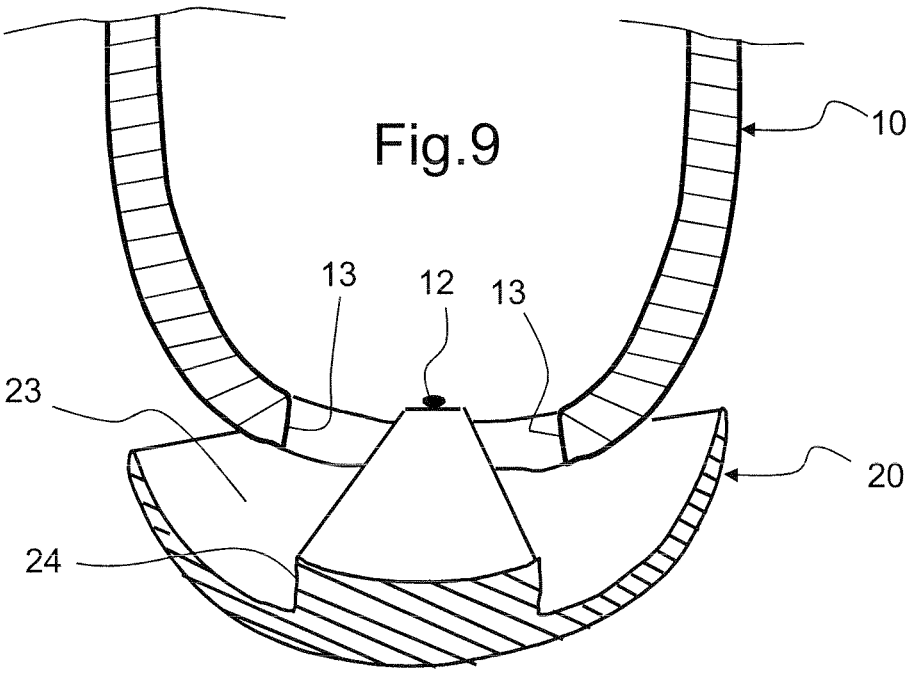
Figure 10:
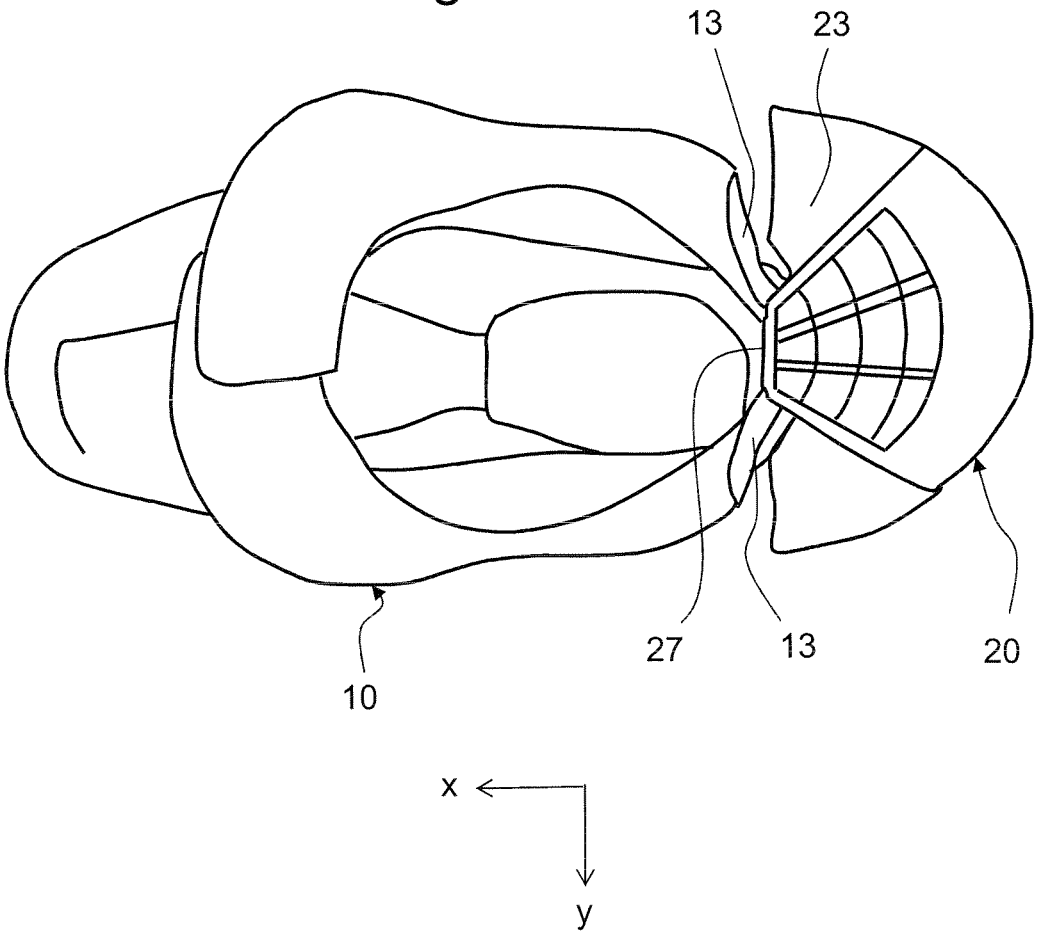
FIG. 10 shows a top perspective view of the ski boot shell with the spoiler in the position tilted backward for walking according to the embodiment of the invention.

This shell structure is advantageous, since its spoiler 20 can move between a first position provided for skiing, in which it abuts on the rear surface of the shell 10, and a second position provided for walking, in which it at least partially moves backward, freeing the notch 11 and allowing the bottom of the leg to straighten to thereby facilitate walking for the skier, as shown in FIGS. 7 and 9. As an aside, in the described embodiment, the movement of the spoiler is similar to a rotation around a transverse axis 15 delimited by the lower edge 17 of the notch 11.

Figure 4:
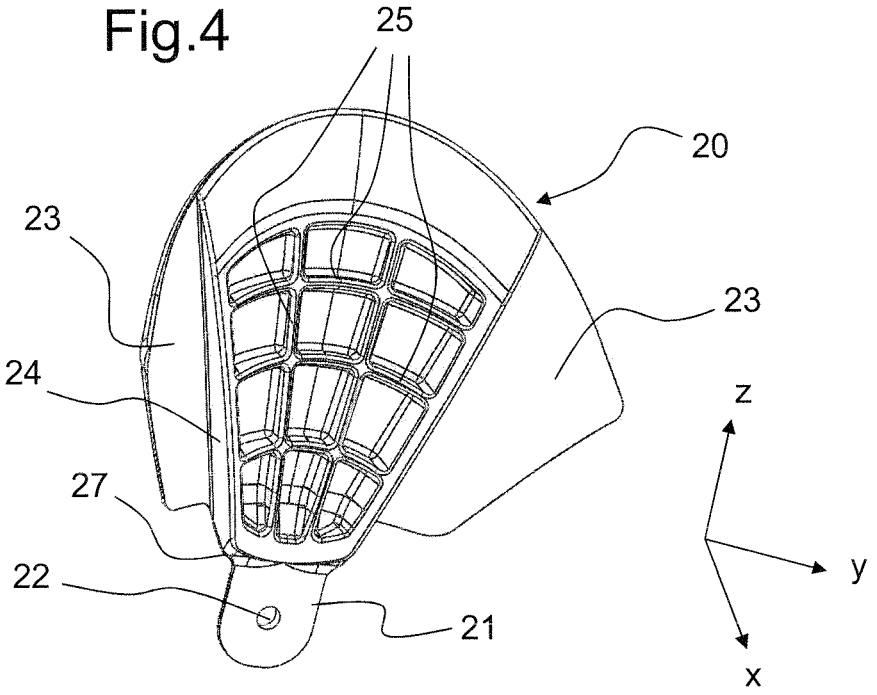
FIG. 4 shows a perspective view of the front surface of the spoiler of the ski boot shell according to the embodiment of the invention.
Figure 5:
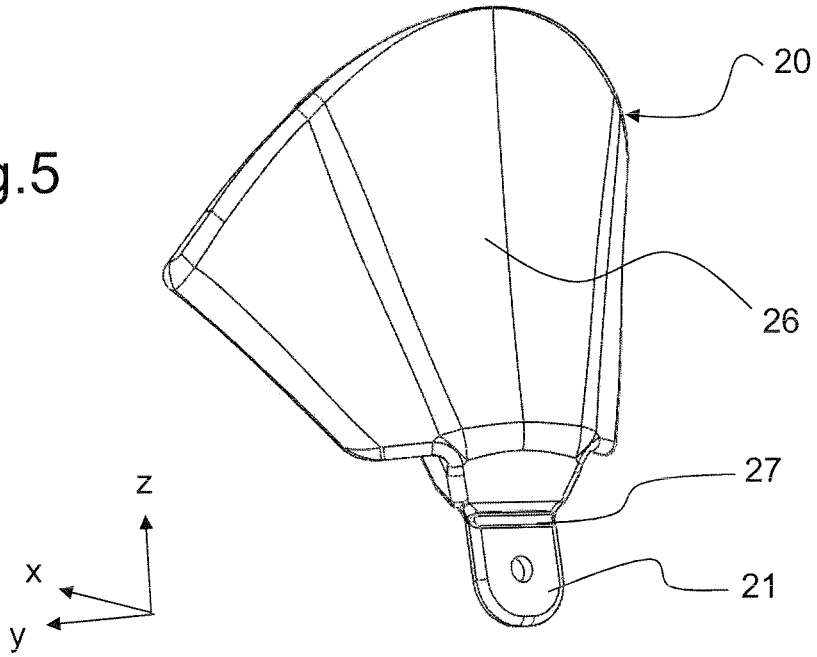
FIG. 5 shows a perspective view of the rear surface of the spoiler of the ski boot shell according to the embodiment of the invention.
Figure 6:
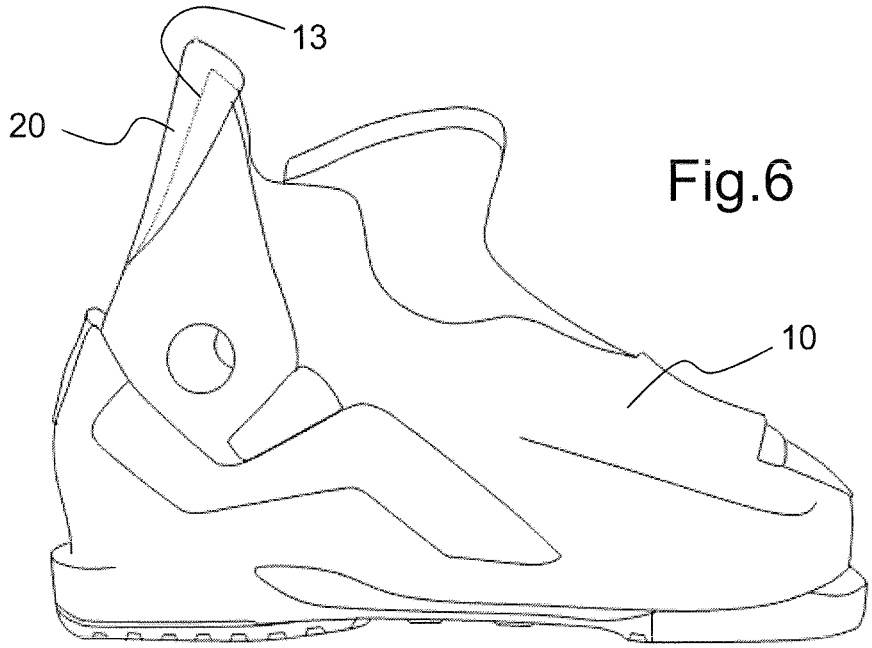
FIGS. 6 and 7 show side views of the ski boot shell respectively with the spoiler in the ski position and in its position tilted backward for walking according to the embodiment of the invention.

FIGS. 4 and 5 more particularly show the spoiler according to one embodiment. It assumes the form of a monolithic plastic element, advantageously formed by a single plastic injection step.

FIG. 4 illustrates the front surface of the spoiler 20, i.e. the surface oriented toward the inside of the shell 10. It comprises a tongue 21 in the lower portion thereof, within which an opening 22 is provided intended to receive the aforementioned fastening element 12. As an aside, this tongue 21 is positioned inside the shell 10, to facilitate maintenance thereof during backward thrust exerted on the spoiler by the skier's leg. Alternatively, it could, however, be fastened on the outer surface of the shell. It also comprises two side surfaces 23 intended to bear on the rear surface of the shell 10, then a raised central portion intended to occupy the free space of the notch 11. This raised portion forms two raised side surfaces 24 intended to bear against the surfaces arranged in the thickness of the side walls 13 of the notch. These raised side surfaces 24 are oriented in a direction substantially perpendicular to the side surfaces 23, these two joined surfaces thus forming a shoulder. The latter guarantees proper positioning and maintenance of the spoiler 20 relative to the shell 10 in both the longitudinal x and transverse y directions in the ski position of the spoiler. This connecting structure using a double stop of the shoulder type between the spoiler and the shell allows the latter to have an overall stiffness similar to that of the shells of the state of the art when it is in the ski position, and when the spoiler is kept in the stop position under pressure from a collar. To optimize this effect, the spoiler is preferably made from a rigid material, with a stiffness similar to the rest of the shell.

The raised central portion of the spoiler 20 comprises reinforcing ribs 25, with a thickness substantially equal to the thickness of the shell 10, to be housed in the free volume of the notch 11. Furthermore, the border between the tongue 21 and the rest of the spoiler has a thinner area 27 extending in the transverse direction, intended for positioning at the lower edge 17 of the notch 11. It thus forms a transverse axis of rotation 15 through the flexibility of the plastic material combined with its reduced thickness and its bearing at an edge 17 of the shell. The rear surface 26 of the spoiler, visible in FIG. 5, has a smooth and continuous surface, making it possible to complete the outer surface of the shell continuously in its first ski position.

The invention also relates to a ski boot, like that described in FIG. 1, incorporating a shell according to the invention, as described above. This rigid shell 10, generally made from a plastic material such as a polyurethane with a hardness comprised between 40 and 60 Shore D or any other material with an equivalent stiffness, and obtained by injection, surrounds the skier's foot. A rigid collar 3, also obtained by injecting a material similar to that of the shell, is rotatably mounted around an axis 14 at a side surface of said shell so as to surround the bottom of the skier's leg. These two rigid elements, forming an upper, are equipped with a central notch to allow spacing, making it easier to put the boot on and remove it. The two flaps formed on either side of that notch are connected to each other by fastening devices making it possible to bring said flaps closer together, and to close and tighten the rigid upper of the boot formed by joining the shell and the collar. As an aside, such a boot thus comprises the assembly of at least three separate parts, i.e. the shell, the spoiler and the collar. Lastly, a comfort inner boot is inserted into said upper.

Figure 11:
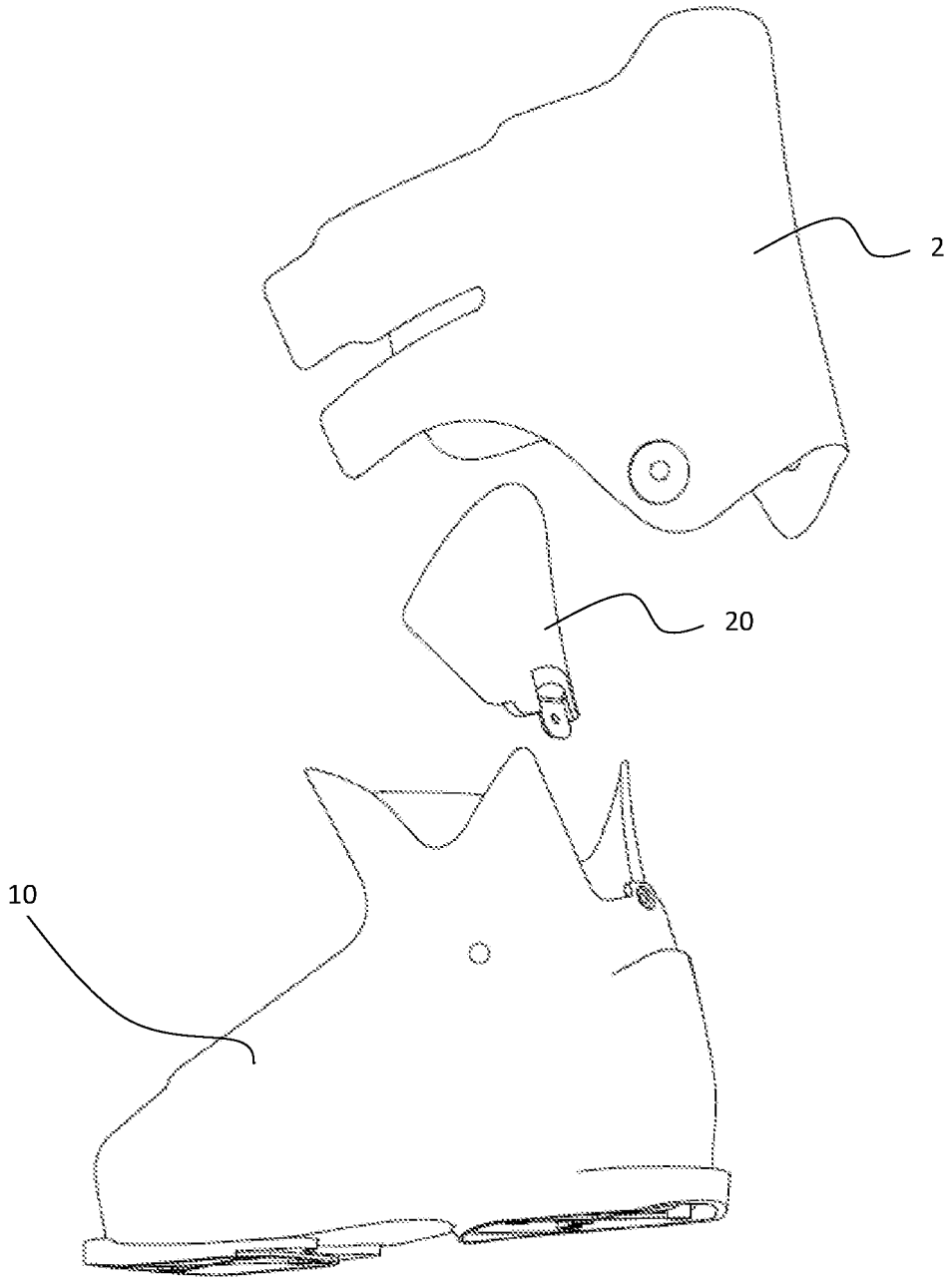
FIG. 11 shows an exploded, perspective view of the ski boot shell with the spoiler and the collar according to an embodiment of the invention.

The operation of the ski boot according to the invention will now be explained. In a first ski position, the boot is tightened, using fastening devices, and the skier's leg is blocked and tightened in the inclined ski position. In this configuration, the collar bears on the outer surface of the shell and keeps the spoiler in its first ski position, as explained above and more particularly shown in FIGS. 6, 8 and 11. The shell and its spoiler in the ski position thus represent an assembly with a form similar to the shells of the state of the art, which is completely suitable for skiing.

When the skier has finished skiing and needs to walk, he loosens the fastening devices of his boot, which makes it possible to loosen his leg and leave him enough freedom to stand upright. In this movement, the rear portion of the bottom of the skier's leg bears on the spoiler and pushes it backward in relation to the shell, accompanying it in backward rotation potentially with the collar, in particular if the latter can be unlocked to completely free its possibility of backward rotation. Owing to the movable spoiler and the rear notch of the shell, the skier's leg acquires the possibility of becoming much more upright than in traditional boots, since the shell no longer blocks such freedom, to thereby achieve significantly increased walking comfort. It will be noted that this straightening movement of the skier's leg is not only possible due to the presence of the notch freed by the spoiler, but also because the two surfaces of the shell around the notch acquire a flexibility that allows them to deform under the rear pressure of the leg.

As an aside, the solution according to the invention is naturally compatible with all uppers of the state of the art, and is in particular especially complementary with solutions making it possible to unlock the inclined position of the collar in relation to the shell, to best free the possibility of backward movement of the skier's leg for walking. This is further shown in FIG. 11, which illustrates the shell 10, collar 2 and spoiler 20 in an exploded, perspective view.

Naturally, the invention is not limited to the ski boot shell outlined above as an example. Alternatively, the shell could assume another form, and the notch could occupy any other surface and have any other shape. Preferably, it extends at least over one quarter, or even one third, of the height of the shell, and/or over at least half the width of the upper opening of the shell provided to insert the foot, measured in the resting position of the shell, to offer enough freedom for the skier's leg. However, it is also possible to consider choosing a notch assuming the form of a narrow slit, but with a significant length.

Likewise, the spoiler could assume another shape, in particular at its bearing surfaces forming a stop of the shoulder type on the shell. In fact, any other configuration making it possible to obtain a stop in the two longitudinal x and transverse y directions could be suitable, even using a single inclined bearing surface, the shell having a corresponding inclined surface at its side edges 13. Also alternatively, the described shoulder could assume another form. According to one simplified alternative, the stop of the spoiler could exist only in the longitudinal direction, to guarantee that the spoiler does not pass through the notch 11 toward the inside of the shell, where it would risk colliding with the skier's leg. Furthermore, the spoiler could be made from any other material and/or assume the form of several elements fastened together. It could be fastened on the shell differently, for example by a lateral fastening point, positioned at one of the side edges of the notch on the rear surface of the shell, in which case its movement could for example approach a rotation around a vertical axis. It could thus be movable along an axis of rotation in any other direction, but preferably positioned in the surroundings of the notch, at the rear surface of the shell. Alternatively, it could be connected to the shell using any other fastening means, such as a weld or adhesive for example, and/or with one or more fastening points or a fastening line or surface. In all of these cases, this fastening is preferably positioned at the rear surface of the shell, preferably near the notch, and not on a side surface of the shell for example. Its movement could be different by a simple rotation. It could also not completely close the notch in the ski position. It could assume any other form, but preferably comprising a surface area smaller than or equal to two times the surface area of the notch. Likewise, its height preferably remains limited, not exceeding the maximum height of the shell by more than 5 cm, i.e. with a height smaller than or equal to the height of the shell plus 5 cm.

Furthermore, a boot could comprise several spoilers 20 with different properties, for example with different hardnesses, to allow a skier to choose the spoiler from amongst a plurality of existing spoilers representing the best compromise between the two extreme cases of a very rigid spoiler favorable for skiing and less comfortable, for example for competitive skiing, and on the other hand a very flexible spoiler, more comfortable but lower-performing for skiing, well suited to beginners. The choice of the spoiler thus makes it possible to define the stiffness of the shell in the ski position. To that end, the spoiler is naturally removably mounted on the shell, i.e. using a device allowing it to be removed easily, preferably without tools. On the contrary, the spoiler could not be removable, i.e. fastened using a device not provided for removal of the spoiler, that removal being either impossible or very difficult and not user-friendly.

The invention also relates to a method for manufacturing a ski boot shell, comprising a first step for manufacturing a rigid outer shell by injecting a rigid plastic material, and comprising a second step for manufacturing a spoiler, then a step for fastening the spoiler on the rigid outer shell, movably at a rear notch. This step for manufacturing the spoiler may consist of a second step for injecting a plastic material. As seen above, the method may comprise a third step for injecting a plastic material to form a second spoiler intended for the same shell, with mechanical properties different from those of the first spoiler.

Such a solution according to the invention offers the advantage of great ease of manufacturing the boot, since the shell differs from the usual shells only by the addition of a notch. Its production mold is therefore easy and inexpensive to manufacture. Furthermore, the spoiler assumes a relatively simple shape that is easy and inexpensive to manufacture.

The invention claimed is:

1. A ski boot, comprising:

a lower shell, shaped as a boot, configured to surround a skier's foot, comprising:

a rear outer surface; and a notch formed in a rear upper portion of the lower shell, wherein the notch extends along a length of the rear outer surface from a top of the lower shell into the rear upper portion and, and wherein the notch forms a trapezoidal V- or U-shape along the length:

a moveable rear bearing element directly mounted on the lower shell comprising;

a rear outer surface; and at least one inner surface;

a collar configured to surround the entire bottom of the skier's leg that is hinged on the lower shell, wherein the collar surrounds a rear outer surface of the lower shell and a rear outer surface of the rear bearing element; and a plurality of fastening devices, wherein the moveable rear bearing element is capable of occupying a first position in which the at least one inner surface of the moveable rear bearing element abuts against the rear outer surface of the lower shell to completely close the notch, and a second position withdrawn backward relative to the rear outer surface of the lower shell to allow a leg of the skier to facilitate walking, and wherein in the first position, the boot is tightened and the collar bears on the rear outer surface of the lower shell and on the rear outer surface of the moveable rear bearing element and in the second position, the plurality of fastening devices of the ski boot are loosened enabling the pushing of the moveable rear bearing element backward away from the rear outer surface of the lower shell, accompanying in backward rotation the collar in relation to the lower shell.

2. The ski boot according to claim 1, wherein the notch extends over at least one quarter or one third of the height of the lower shell and over at least half the width of an upper opening of the notch; or wherein the notch extends over at least one quarter or one third of the height of the lower shell or at least half the width of an upper opening of the notch.

3. The ski boot according to claim 1, wherein the moveable rear bearing element has a surface area smaller than or equal to two times a surface area of the notch and a height not exceeding the height of the lower shell by more than 5 cm; or wherein the moveable rear bearing element has a surface area smaller than or equal to two times a surface area of the notch or a height not exceeding the height of the lower shell by more than 5 cm.

4. The ski boot according to claim 1, wherein the moveable rear bearing element is fastened to the lower shell at the rear surface of the lower shell near the notch.

5. The ski boot according to claim 1, wherein the moveable rear bearing element is rotatably mounted around an axis arranged near the notch around a horizontal axis.

6. The ski boot according to claim 1, wherein the moveable rear bearing element comprises:

a tongue fastened on the lower shell, and an area forming an axis of rotation at the border between the tongue and the rest of the moveable rear bearing element.

7. The ski boot according to claim 1, wherein the moveable rear bearing element abuts on the rear outer surface of the lower shell in the first position, which prevents the moveable rear bearing element from moving both in a longitudinal direction (x), forward, and a transverse direction (y).

8. The ski boot according to claim 7, wherein the moveable rear bearing element has a shoulder or an inclined surface to abut on one or more surface(s) of the lower shell.

9. The ski boot according to claim 1, wherein the moveable rear bearing element is fastened to the lower shell, and wherein the lower shell is made from a material with a hardness comprised between 40 and 60 ShD.

10. The ski boot according to claim 1, wherein the moveable rear bearing element is removable.

11. The ski boot according to claim 10, comprising at least two moveable rear bearing elements, the at least two moveable rear bearing elements having different flexibilities to enable the skier to fasten the moveable rear bearing element that best suits him.

12. A ski boot, comprising:

a lower shell, shaped as a boot, configured to surround a skier's foot, comprising:

a rear outer surface: and a notch formed in a rear upper portion of the lower shell, wherein the notch extends along a length of the rear outer surface from a top of the lower shell into the rear upper portion and, wherein the notch forms a trapezoidal V- or U-shape along the length;

a moveable rear bearing element directly mounted on the lower shell, comprising: a rear outer surface; and at least one inner surface;

a collar configured to surround the entire bottom of the skier's leg that is hinged on the lower shell, wherein the collar surrounds a rear outer surface of the lower shell and a rear outer surface of the rear bearing element; and a comfort inner boot inserted in an upper, wherein the moveable rear bearing element is capable of occupying a first position in which the at least one inner surface of the moveable rear bearing element abuts against the rear outer surface of the lower shell to completely close the notch.

13. The ski boot according to claim 1, further comprising a locking/unlocking device for locking/unlocking a rear incline of the collar in relation to the lower shell.

14. A method for manufacturing a ski boot comprising: injecting plastic material to produce a lower shell, shaped as a boot, to surround a skier's foot;

forming a notch in a rear upper portion of the lower shell, wherein the notch extends along a length of a rear outer surface from a top of the lower shell into the rear upper portion and, wherein the notch forms a trapezoidal V- or U-shape along the length;

producing a rear bearing element with two inner side surfaces;

directly mounting the rear bearing element on the lower shell so that a collar surrounds the rear outer surface of the lower shell and a rear outer surface of the rear bearing element, and fastening the rear bearing element on the lower shell near the notch thereof so that the two inner side surfaces abut against an outer surface of the rear outer surface of the lower shell in a first position where the bearing element completely closes the notch and a second position withdrawn backward relative to the rear outer surface of the lower shell, and injecting plastic material to produce the collar that is hinged on the lower shell to completely surround the bottom of the skier's leg;

wherein in the first position, the boot is tightened and the collar bears on the rear outer surface of the lower shell and on the rear outer surface of the rear bearing element; and wherein in the second position, a plurality of fastening devices of the ski boot are loosened enabling pushing of the rear bearing element backward away from the rear outer surface of the lower shell, accompanying in backward rotation the collar in relation to the lower shell.

15. The manufacturing method according to claim 14, wherein the step for producing the rear bearing element includes a step of injecting a plastic material.

16. The ski boot according to claim 12, comprising a locking/unlocking device for locking/unlocking the rear incline of the collar in relation to the lower shell.

17. A ski boot shell, comprising:

a collar configured to completely surround the bottom of a skier's leg; and a lower shell, shaped as a boot, configured to surround a skier's foot;

wherein a notch is formed in the rear upper portion of the lower shell;

wherein the notch extends along a length of a rear outer surface from a top of the lower shell into the rear upper portion and, wherein the notch forms a trapezoidal V- or U-shape along the length; and wherein the collar is hinged on the lower shell; and a rear bearing element mounted directly on the lower shell and movable with respect to the lower shell, the rear bearing element capable of occupying a first position in which at least one inner surface of the rear bearing element abuts against the rear outer surface of the lower shell to completely close the notch, and a second position withdrawn backward where the bearing element is positioned rearwardly relative to the rear outer surface of the lower shell to allow a leg of the skier to facilitate walking, wherein the collar surrounds a rear outer surface of the lower shell and a rear outer surface of the rear bearing element, wherein in the first position, the boot is tightened and the collar bears on the rear outer surface of the lower shell and on the rear outer surface of the rear bearing element; and wherein in the second position a plurality of fastening devices of the ski boot are loosened enabling the pushing of the rear bearing element backward away from the rear outer surface of the lower shell, accompanying in backward rotation the collar in relation to the lower shell.

18. The ski boot according to claim 12, wherein the collar is rotatably mounted around an axis at a side surface of the lower shell so as to surround a bottom of the skier's leg, and wherein in the first position, the boot is tightened and the collar bears on the outer surface of the lower shell and keeps the moveable rear bearing element in a first ski position, and wherein in a second ski position, fastening devices of the ski boot are loosened enabling the pushing of the moveable rear bearing element backward in relation to the lower shell, freeing the notch against the outer surface of the lower shell, accompanying in backward rotation the collar in relation to the lower shell.

19. The ski boot according to claim 1, wherein the moveable rear bearing element comprises a raised central portion that occupies a free space of the notch when the moveable rear bearing element is in the first position, the raised central portion protruding along the length towards an inside of the lower shell in a direction normal to the at least one inner surface and approximate located along the middle of the rear bearing element.

20. The ski boot according to claim 19, wherein the raised central portion forms two raised side surfaces oriented in a direction normal to the at least one inner surface that bear against the surfaces arranged in the thickness of the sidewalls of the notch.

21. A ski boot shell comprising:

a collar configured to completely surround the bottom of a skier's leg; and a lower shell, shaped as a boot, configured to surround a skier's foot;

wherein the lower shell comprises:

a rear outer surface: and a notch in a rear upper portion thereof, wherein the notch extends along a length of the real-outer surface from a top of the lower shell into the rear upper portion and, wherein the notch forms a trapezoidal V- or U-shape along the length;

wherein the ski boot shell further comprises a rear bearing element movably mounted on the lower shell, capable of occupying a first position in which the rear bearing element abuts against a rear outer surface of the lower shell with two inner side surfaces that overlap the rear outer surface of the lower shell to completely close the notch, and a second position withdrawn backward freeing the notch to allow the leg of a skier to be straightened in a facilitate walking phase and the rear bearing element having a stop to guarantee it does not pass through the notch toward the inside of the lower shell, and wherein the collar surrounds a rear outer surface of the lower shell and a rear outer surface of the rear bearing element.

22. A ski boot shell according to claim 21, wherein the stop is formed by a shoulder.

23. A ski boot according to claim 1, wherein in the second position, the moveable rear bearing element frees the notch of the lower shell.

24. A ski boot according to claim 1, wherein in the first position, the moveable rear bearing element abuts against the rear outer surface of the lower shell beyond side walls of the notch with two side surfaces that overlap the rear outer surface of the lower shell.

25. The ski boot according to claim 1, wherein the moveable rear bearing element comprises a raised central portion, the raised central portion comprising two raised side surfaces oriented in a direction normal to the at least one inner surface and protruding along the length towards an inside of the lower shell, the two raised side surfaces configured to bear against a sidewall in the lower shell formed by the notch.

26. The ski boot according to claim 19, wherein the raised central portion has a shape that generally conforms to the shape of the notch.

* * * * *